US007308814B2

(12) United States Patent
Gassner

(10) Patent No.: US 7,308,814 B2
(45) Date of Patent: Dec. 18, 2007

(54) METHOD FOR PERFORATING A SHEET

(75) Inventor: Wolfgang Gassner, Neuzeug (AT)

(73) Assignee: Gassner Ges.m.b.H. & Co KG, Neuzeug (AT)

( * ) Notice: Subject to any disclaimer, the term of this patent is extended or adjusted under 35 U.S.C. 154(b) by 0 days.

(21) Appl. No.: 11/249,580

(22) Filed: Oct. 13, 2005

(65) Prior Publication Data

US 2007/0095176 A1 May 3, 2007

(51) Int. Cl.
*B21D 28/00* (2006.01)

(52) U.S. Cl. ..... 72/333; 72/327; 72/379.2; 72/470

(58) Field of Classification Search ..... 493/56, 493/61, 63, 73, 227, 340, 480; 83/686; 72/327, 72/329, 330, 333, 335, 336, 337, 379.2, 412, 72/420

See application file for complete search history.

(56) References Cited

U.S. PATENT DOCUMENTS

| | | | | | |
|---|---|---|---|---|---|
| 770,239 | A | | 9/1904 | Lovejoy | |
| 904,714 | A | * | 11/1908 | McGrath | 83/686 |
| 1,342,865 | A | | 6/1920 | Ormes | |
| 1,695,476 | A | * | 12/1928 | Winkler | 72/334 |
| 1,904,951 | A | * | 4/1933 | Peterson | 83/140 |
| 2,369,869 | A | | 2/1945 | Testo | |
| 2,369,896 | A | * | 2/1945 | Harris et al. | 83/685 |
| 2,928,450 | A | * | 3/1960 | Belding | 72/328 |
| 2,928,451 | A | * | 3/1960 | Taylor | 72/328 |
| 3,044,167 | A | | 7/1962 | Mathieu | |
| 3,078,574 | A | * | 2/1963 | Dubecky | 30/358 |
| 3,108,371 | A | * | 10/1963 | Munse | 72/327 |
| 3,189,238 | A | | 6/1965 | Sherril | |
| 3,494,168 | A | * | 2/1970 | Williamson | 72/335 |
| 3,641,860 | A | * | 2/1972 | Whistler et al. | 83/686 |
| 3,724,305 | A | | 4/1973 | Kondo | |
| 3,776,016 | A | * | 12/1973 | Quinn et al. | 72/327 |
| 4,072,039 | A | * | 2/1978 | Nakanishi | 72/334 |
| 4,273,015 | A | * | 6/1981 | Johnson | 83/670 |
| 4,526,077 | A | | 7/1985 | DeGuvera | |
| 5,235,881 | A | * | 8/1993 | Sano et al. | 83/55 |
| 5,816,093 | A | * | 10/1998 | Takeuchi et al. | 72/327 |
| 5,927,137 | A | * | 7/1999 | Sinteff | 72/335 |
| 5,992,280 | A | | 11/1999 | Oishi et al. | |

FOREIGN PATENT DOCUMENTS

| | | |
|---|---|---|
| DE | 2056828 | 6/1971 |
| DE | 2706849 | 11/1977 |
| EP | 0325947 | 8/1989 |
| EP | 1103317 | 5/2001 |
| FR | 2690097 | 10/1993 |
| GB | 644963 | 10/1950 |

* cited by examiner

*Primary Examiner*—Ed Tolan
(74) *Attorney, Agent, or Firm*—Collard & Roe, P.C.

(57) ABSTRACT

A method for perforating a sheet (1) with the aid of a stamp (3) and a matrix (2) is described, the sheet (1) being elongated before the hole punching in accordance with the setpoint diameter in the hole boundary area through bulging of the hole area. In order to be able to stamp flat perforated sheets, it is suggested that the sheet (1) be countersunk through embossing in the hole boundary area on the side diametrically opposite the matrix (2) after the hole punching to equalize internal tensions.

2 Claims, 1 Drawing Sheet

METHOD FOR PERFORATING A SHEET

1. Field of the Invention

The present invention relates to a method for perforating a sheet with the aid of a stamp and a matrix, the sheet being elongated in accordance with the setpoint diameter in the hole boundary area through bulging of the hole area before the hole punching.

2. Description of the Prior Art

Since a conically expanding punched hole in the stamp direction results during hole punching of sheets through the interaction of stamp and matrix because of the larger diameter of the matrix than the stamp, expanding the stamp following an axial section having a reduced diameter to the nominal diameter of the punched hole is known (U.S. Pat. No. 2,369,896), in order to not only stamp out the hole punching, but rather also to expand the hole wall to the nominal diameter through cold shaping, in one work step. The flow of the material toward the matrix-side hole edge caused by this, and also the material displacement caused by the stamp if continuous cylindrical stamps are used, cause tensions in the hole boundary area on the matrix side, which may result in bulging of the sheet if multiple holes are punched, which must then be subjected to a subsequent alignment procedure.

In order to increase the carrying capacity of sheets made of an aluminum material in the area of screw holes, preshaping a sheet, which is pressed against a matrix by a pressure pad, between a terminus stamp which closes the punch opening of the matrix and a press stamp in the hole area in such a way that the material displaced between the press stamp and the terminus stamp flows radially outward and causes thickening of the sheet along the hole boundary area, is known (EP 1 103 317 A2).

The punch stroke of the press stamp may then be performed with the retraction of the terminus stamp and the hole punching may be punched out. The desired increase of the carrying capacity of the sheet in the hole area is achieved by the material accumulation in the hole boundary area and the strain hardening connected therewith. Such a method for hole punching requires thickening of the hole boundaries in the course of the punching procedure and is therefore unsuitable in principle for avoiding bulging of sheets, in which no hole boundary thickenings are to be provided, caused by punching.

In addition, to reduce the punching forces to be applied, providing the stamp with a stamp extension that projects axially toward the matrix over a punch section, which causes additional tensions in the sheet upon bulging of the hole area, so that lower forces are required for the following shear procedure, is additionally known (U.S. Pat. No. 4,526,007 A, U.S. Pat. No. 770,239A). This measure, which is used for reducing the punching forces, requires asymmetrical tensions in relation to a central plane of the punched sheet, which results in sheet bulging if multiple holes are punched. This is also not changed if, to produce dimensionally accurate holes, holes having a larger diameter are first punched, in order to then provide countersinking through an embossing stamp on the side diametrically opposite the matrix, which requires a material flow over the entire hole length necessary to achieve the setpoint diameter established by a corresponding embossing stamp extension, because in this case the sheet tensions caused by the countersinking also produce a bulge of the sheet if multiple holes are produced in this way.

SUMMARY OF THE INVENTION

The present invention is therefore based on the object of implementing a method for perforating a sheet in such a way that the inclination of the sheet to bulge during punching may be counteracted, so that level perforated sheets may be obtained without complex realignment.

Proceeding from a method of the type described at the beginning, the present invention achieves the stated object in that the sheet is countersunk on the side diametrically opposite the matrix through embossing in the hole boundary area after the hole punching to equalize internal tensions.

The present invention is therefore based on the idea of first elongating the sheet before the hole punching in the hole boundary area in a way known per se through bulging of the hole area, with the goal of reducing later material accumulations in the hole boundary area on the matrix side caused by the punching procedure. The deep drawing procedure caused through this pretreatment of the hole area before the actual punch processing causes, in connection with countersinking of the hole boundary area following the punch processing through an embossing procedure on the side of the sheet diametrically opposite the matrix, equalization of internal sheet tensions. The punch-caused tensions on the matrix side may be counteracted with tensions in the hole boundary area on the side diametrically opposite the matrix using the cold deformation of the sheet caused by embossing of countersinking of the punched holes, so that these tensions on the two sheet sides are cancelled out in regard to the tendency to bulge, which allows the punching of flat perforated sheets without complex realignment. The dimension of the countersinking necessary for this purpose in each case is a function of the particular punching conditions and may be determined easily through prior experiments. For adaptation to the particular punching conditions, the countersinking depth and the angle of the countersinking may be changed. If the countersinking of the hole boundary area is performed in the same work step as the hole punching, which is not absolutely necessary, no additional work outlay results for the hole punching according to the present invention.

To perform the method, one may proceed from a typical device for perforating a sheet having a matrix and a stamp, because the stamp must only be provided with a stamp extension, which projects axially beyond a punch section toward the matrix, for bulging the hole area of the sheet, and, axially adjoining the punch section on the side facing away from the matrix, with a conically expanded shoulder for embossing countersinking. Since, during the hole punching, the stamp extension projecting beyond the punch section of the stamp toward the matrix is first placed on the hole area, this is bulged into the matrix opening while stretching the participating material parts before the actual punching procedure is initiated with the aid of the punch section. The conically expanded shoulder adjoining the punch section may be used immediately after punching out the hole punching, so that typical conditions also result in regard to the stamp stroke. It must only be ensured that the countersinking of the hole boundary area remains correspondingly restricted, so that opposing bulging of the sheet is not caused.

BRIEF DESCRIPTION OF THE DRAWING

The method according to the present invention will be explained in greater detail on the basis of the drawing.

DESCRIPTION OF THE PREFERRED EMBODIMENT

Figure 3:
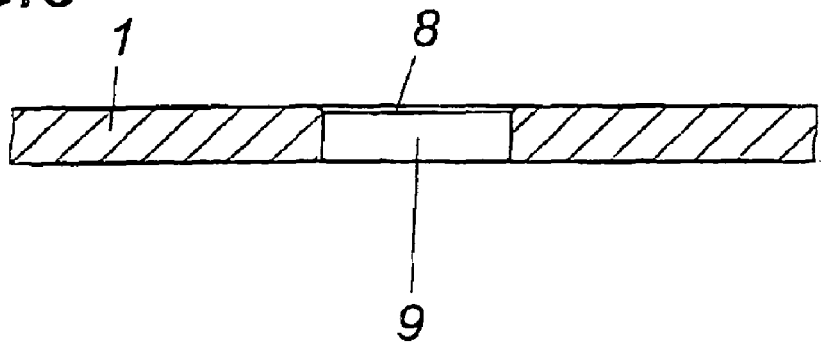
FIG. 3 shows the processed sheet with the punched hole partially in cross-section.

The schematically illustrated device for perforating a sheet 1 comprises a matrix 2 and a stamp 3, which, according to the exemplary embodiment, has a cutting edge 5 in the front area of a punch section 6 which works together with a peripheral counter cutting edge 4 of the matrix 2. A conically expanded shoulder 7 adjoins this punch section 6 of the stamp 3, which is used for embossing countersinking 8 of the punched hole 9, as may be inferred from FIG. 3.

Figure 1:
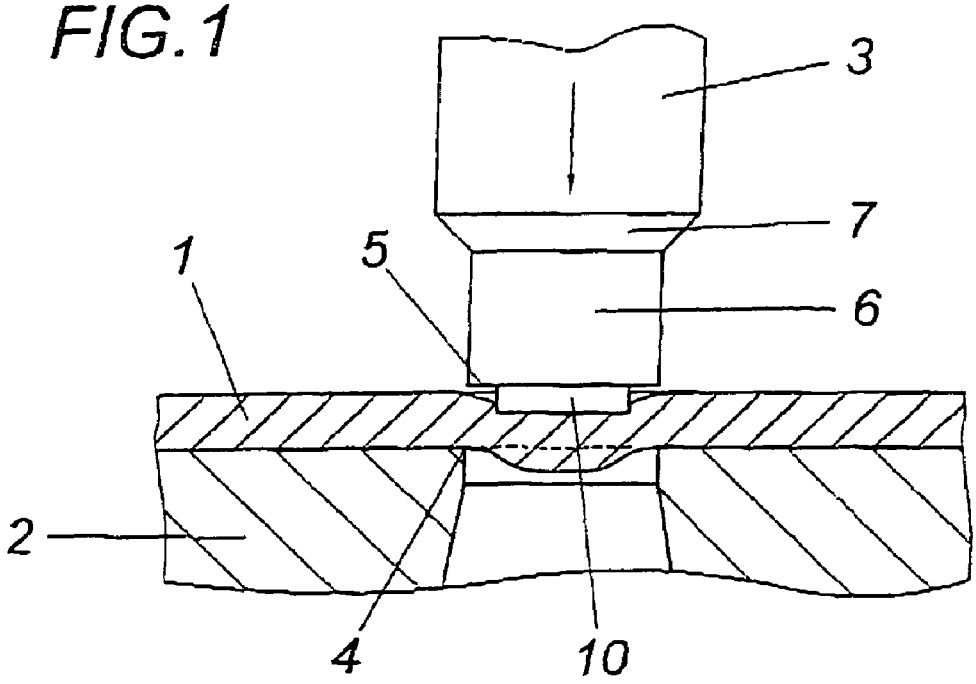
FIG. 1 shows a device according to the present invention for perforating a sheet in the initial phase of the processing in a schematic axial section.

A stamp extension 10 projects axially on the front side of the punch section 6 of the stamp 3 forming the cutting edge 5, which causes preliminary bulging of the sheet 1 into the matrix opening before the actual punching procedure as shown in FIG. 1. Stretching of the sheet 1 in the area of the hole boundaries results through the preliminary bulging of the sheet 1 in the hole area, which results in lesser material accumulation in the area of the hole boundary on the matrix side and therefore lower internal tensions in this hole boundary area during the following punching procedure.

Figure 2:
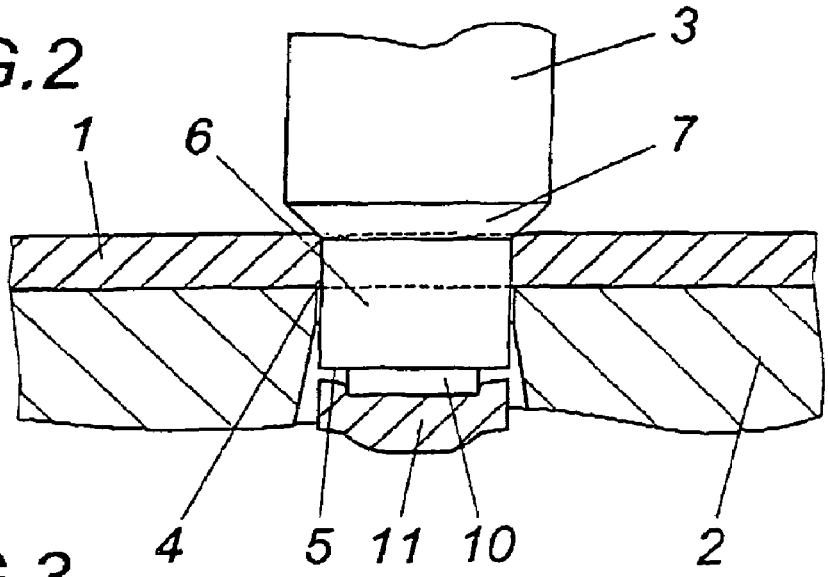
FIG. 2 shows this device in the final phase of the processing.

As may be seen from FIG. 2, directly after the hole punching 11 is punched out, the conically expanded shoulder 7 of the stamp 3 is used, with the aid of which the sheet 1 is processed in the hole boundary area on the side diametrically opposite the matrix 4 by embossing countersinking 8 of the punched hole 9. The cold deformation of the hole boundary area connected with this embossing procedure causes the occurrence of tensions in this hole boundary area, which cause a tendency to bulge on the side of the matrix 4 that is counter to the tensions in the hole boundary area. Therefore, if the tensions caused by the countersinking 8 may be kept in an order of magnitude comparable to the tensions caused by punching on the diametrically opposite side, the effects of these tensions on the two sheet sides largely cancel out, so that sheet 1 remains flat. The size of the countersinking 8 is therefore to be selected in accordance with the particular punching conditions, which may be previously determined through simple prior experiments without difficulty.

The present invention is, of course, not restricted to the exemplary embodiment shown, which shows the punching tool only schematically. Thus, for example, a typical pressure pad is missing, with the aid of which the sheet to be processed is pressed down on the matrix before the stamp is applied. Although especially advantageous constructive conditions result in regard to the stamp implementation having a stamp extension projecting beyond the actual punch section and a conically expanded shoulder following this punch section, the production of perforated sheets is not directed to the use of such stamps, because the individual method steps may also be performed in sequence using separate tools.

What is claimed is:

1. A method of punching a cylindrical hole having a desired diameter in sheet metal having two planar surfaces, comprising the steps of placing one of the surfaces of the sheet metal on a matrix, cambering the sheet metal with a stamp within an area determined by the desired diameter of the hole by countersinking the one sheet metal surface in a boundary area of the cambered sheet metal whereby the sheet metal is stretched in the boundary area by deep drawing and the sheet metal is subjected to internal tensions, subsequently punching the cambered area of the sheet metal out with the stamp to produce the cylindrical hole, and then countersinking the circumference of the hole on the other surface opposite the matrix to equalize the internal tensions while the planar surfaces remain flat.

2. A device for punching a hole in sheet metal according to the method of claim 1 and comprising the matrix and the stamp, the stamp comprising a stamp extension facing the matrix for cambering the sheet metal within the determined area, a punch section for punching the cambered area of the sheet metal out, and a conically expanding shoulder for countersinking the circumference of the hole, the stamp extension, the punch section and the shoulder being axially aligned.

* * * * *